US005390695A

United States Patent [19]

Howard

[11] Patent Number: 5,390,695

[45] Date of Patent: Feb. 21, 1995

[54] REEL ASSEMBLY FOR HOSE

[76] Inventor: Gary B. Howard, 7525 Huntley St., Sebastopol, Calif. 95472

[21] Appl. No.: 133,238

[22] Filed: Oct. 5, 1993

[51] Int. Cl.[6] ..... B65H 75/34

[52] U.S. Cl. ..... 137/355.27; 137/355.16; 242/397.1; 242/399.2; 239/281; 248/76

[58] Field of Search ..... 137/355.16, 355.18, 137/355.19, 355.2, 355.23, 355.26, 355.27; 248/75, 76; 239/198, 280.5, 281, 280; 242/397.1, 399.2

[56] References Cited

U.S. PATENT DOCUMENTS

| | | | |
|---|---|---|---|
| 622,067 | 3/1899 | Patterson | 137/355.26 |
| 2,603,351 | 7/1952 | Vedder | 242/86 X |
| 3,074,649 | 1/1963 | Atkinson | 239/281 X |
| 3,225,974 | 12/1965 | Athas | 242/86 X |
| 5,109,882 | 5/1992 | Eley | 137/355.27 X |
| 5,205,521 | 4/1993 | Smith | 137/355.27 X |

FOREIGN PATENT DOCUMENTS

| | | | |
|---|---|---|---|
| 313334 | 6/1929 | United Kingdom | 137/355.26 |

*Primary Examiner*—Martin P. Schwadron

*Assistant Examiner*—Kevin L. Lee

*Attorney, Agent, or Firm*—Townsend and Townsend Khourie and Crew

[57] ABSTRACT

A reel housing having a coil spring mounted therein for biasing a garden hose wound into the housing reel for storage purposes. A hose segment coupled to water transfer structure in the housing is to be coupled to water transfer structure in the housing and this segment is further to be coupled to a water faucet. The main length of hose is wound in the reel housing until ready for use, whereupon it is unwound, thereby rotating the reel housing relative to the support on which the housing is mounted. The reel housing having hose supporting structure including telescoping tubes, with the tubes extending outwardly from and tangential to the housing. The hose extends outwardly from the reel through the outermost tube when the tubes extend outwardly from the housing. The reel housing also including an adjustable brace coupled to the innermost tube near the outer end thereof. The brace can be adjusted in length to mount the reel at any desired angle relative to the level ground therebelow.

5 Claims, 8 Drawing Sheets

REEL ASSEMBLY FOR HOSE

This invention relates to improvements in the handling of garden hoses for spraying water in and around bushes, shrubs and other growth and, more particularly, to a hose reel which can be used in the manner to avoid damage to underlying growth.

BACKGROUND OF THE INVENTION

When it is desired to use a garden hose for watering shrubs, bushes and other growth in or around a home, the hose must be manipulated through and around such growth in a manner to avoid damage thereto. This is not oftentimes easy because the growth is sometimes thick and only selected areas of other growth to be supplied with water is important to a homeowner intent on watering specific regions of his property.

The hose reels of conventional design are typically mounted on small wheels and a major reel rotates the hose so that it is wound on the wheel and it is unwound therefrom. However, this is not a satisfactory way of handling the hose because the hose comes directly outwardly from the reel and hugs the ground. In so doing, it applies breaking forces to the growth at certain times which is not to be desired, especially if the growth is fragile and easily damaged. Because of this drawback, a need exists for improvements in hose reels which can be provided with mounting structure to prevent damage to underlying growth.

The present invention satisfies this need.

SUMMARY OF THE INVENTION

The present invention is directed to a reel housing which has a coil spring mounted therein for biasing the garden hose wound in the housing in a direction such that the hose is drawn into the housing by the action of the spring and the hose is wound on the wheel for storage purposes.

A hose segment is coupled to water transfer structure in the housing of the reel and this segment is adapted to be coupled to water transfer structure in the housing of the reel and this segment is adapted to be coupled to a water faucet. The main length of hose is wound in the reel housing until ready for use, whereupon it is unwound, thereby rotating the reel housing relative to the support on which the housing is mounted. At the end of the use of the garden hose, the hose is wound back on the cylindrical member in the housing for the reel and this is accomplished by reliance upon the bias force provided by the coil spring wound on the reel.

The primary object of the present invention is to provide an improved garden hose reel which can be mounted in such a way that it is above growth so that the hose, when used, will not damage such growth yet the garden hose is usable in the normal fashion.

Other objects of the present invention will become apparent as the following specification progresses, reference being had to the accompanying drawings for an illustration of the invention.

DETAILED DESCRIPTION OF THE PREFERRED EMBODIMENT

Figure 1:
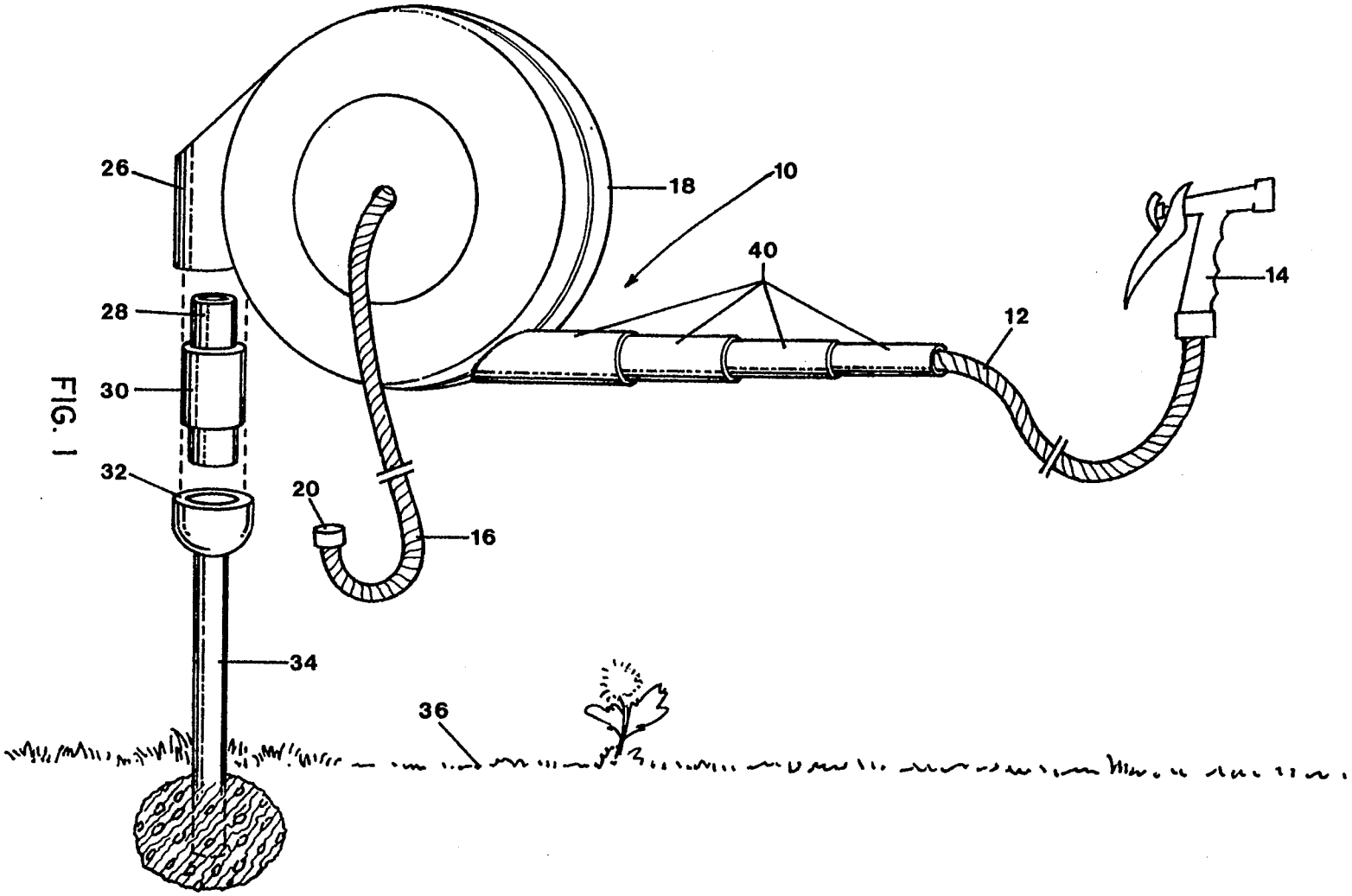
FIG. 1 is a perspective view of a reel for a garden hose with the hose extending outwardly from the reel through telescoping tubes.

The reel assembly of the present invention is broadly denoted by the numeral 10 and is adapted for use with a flexible garden hose 12 which may have a nozzle 14 at one end thereof for controlling the flow of water out of the hose. A hose segment 16 coupled with the housing 18 of assembly 10 is adapted to be coupled by means of a fitting 20 which can be threaded onto the tapped end 22 of a water faucet 24. Water hose segment 16 is coupled by fittings within housing 18 in the manner hereinafter described.

Figure 6:
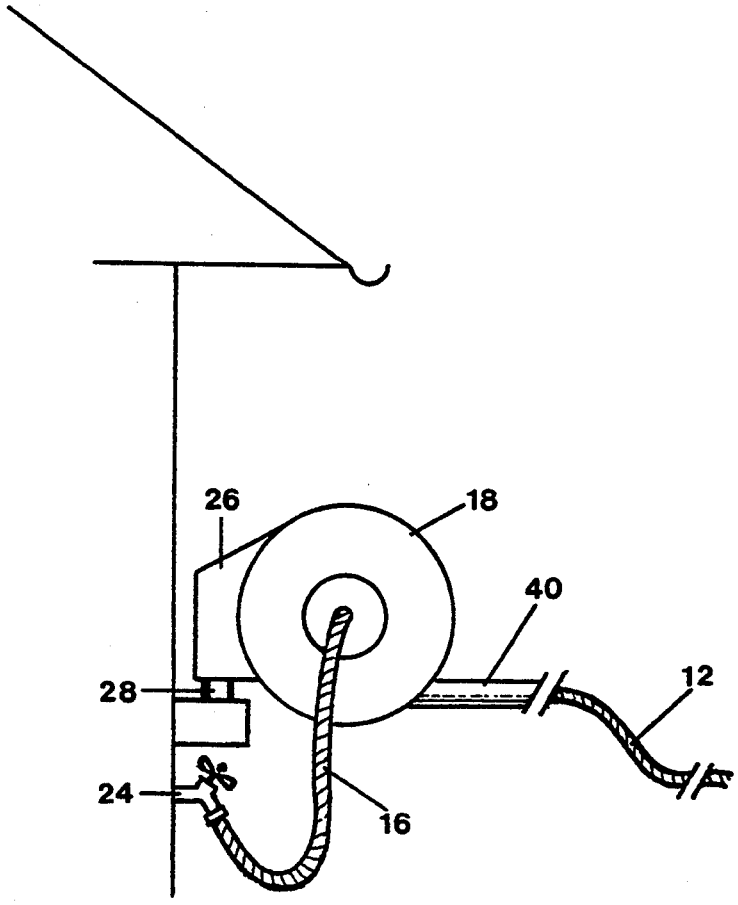
FIG. 6 is a view similar to FIG. 1 but showing the hinge mount for the reel on the side of a building.
Figure 7:
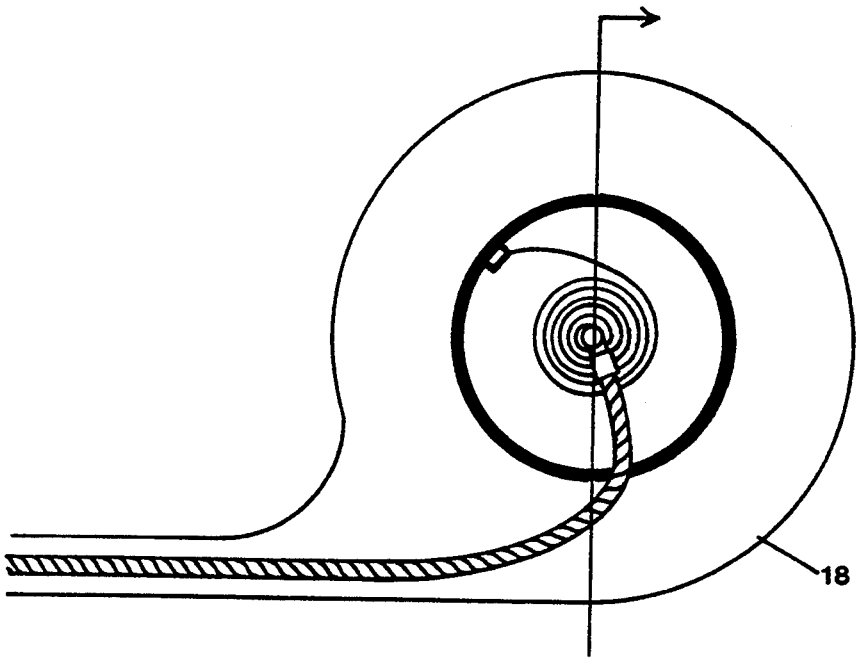
FIG. 7 is a fragmentary, side elevational view of the hose after it has been unwound from the reel, showing the spring wound about the axis of the reel housing.
Figure 8:
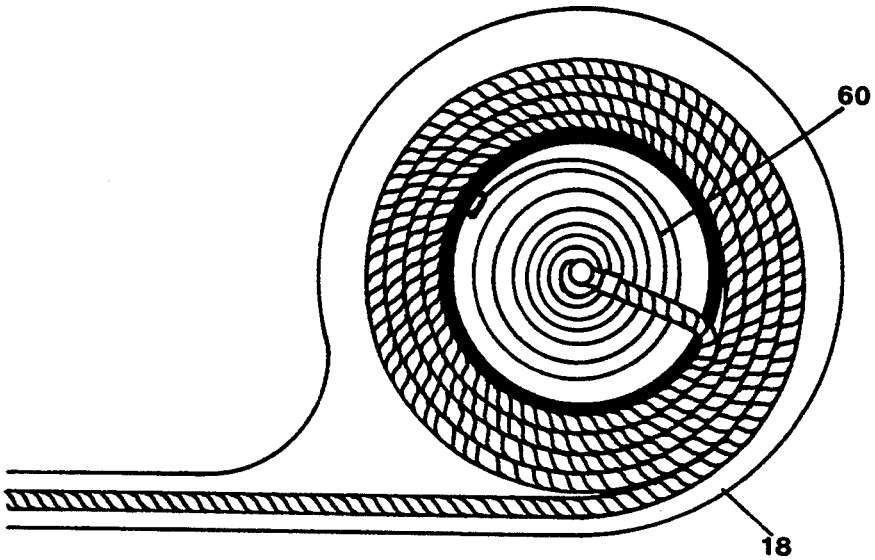
FIG. 8 is a view similar to FIG. 7 but showing the hose wound on the reel housing.

Housing 18 has a tubular hinge part 26 (FIG. 1) which is adapted to fit over and be rotatably mounted relative to a pin 28 having a sleeve 30, the lower end of the pin 28 being received within a tubular, open top sleeve 32 carried by a rod 34 which is driven into the ground so as to extend below ground level 36. Tube 26 is mounted on the cylindrical outer periphery 38 of housing 18 so that the housing can rotate relative to and on pin 28 so as to be rotatable about a vertical axis through the pin. This allows the garden hose 12 to be swung through an angular distance of approximately 180° relative to rod 34 driven into the ground adjacent to a house or building. FIG. 6 is another embodiment of the mounting means.

Figure 3:
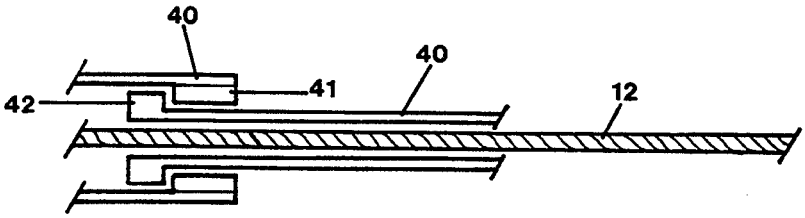
FIG. 3 is an enlarged, cross-sectional fragmentary view of the hose, showing the telescoping extension thereof.

Housing 18 has a plurality of relatively telescoped tubes 40 which are cylindrical in configuration and progressively reduced in diameter as the outer end of the hose 12 is approached. FIG. 3 shows the way in which a pair of adjacent tubes 40 are interconnected. The outer tube 40 has a flange 41 which acts as a stop shoulder 42 on the adjacent tube 40 so that the shoulder, when it abuts the rear face of flange 41, will be prevented from further travel out of the first mentioned tube 40 and, in this way, the various tubes 40 can be pulled out or pushed in depending upon how much support the hose needs to elevate it above the ground, or above shrubbery or flowers, when reel assembly 10 is put into use.

Figure 2:
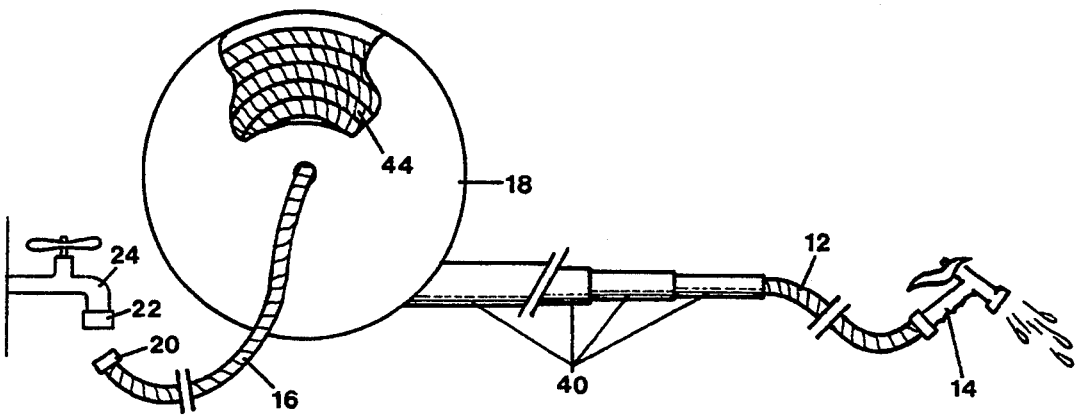
FIG. 2 is a side elevational view, partly broken away and in section, showing the reel connected to a water faucet and showing the hose wrapped on the reel housing.

FIG. 3 further shows that hose 12 is carried by the tubes 40. FIG. 2 shows that hose segment 16 is coupled to the center of the reel housing and that the hose is wound about the center on a reel member 44 which is concentric with the axis which is generally horizontal through the center of the housing 18.

Figure 4:
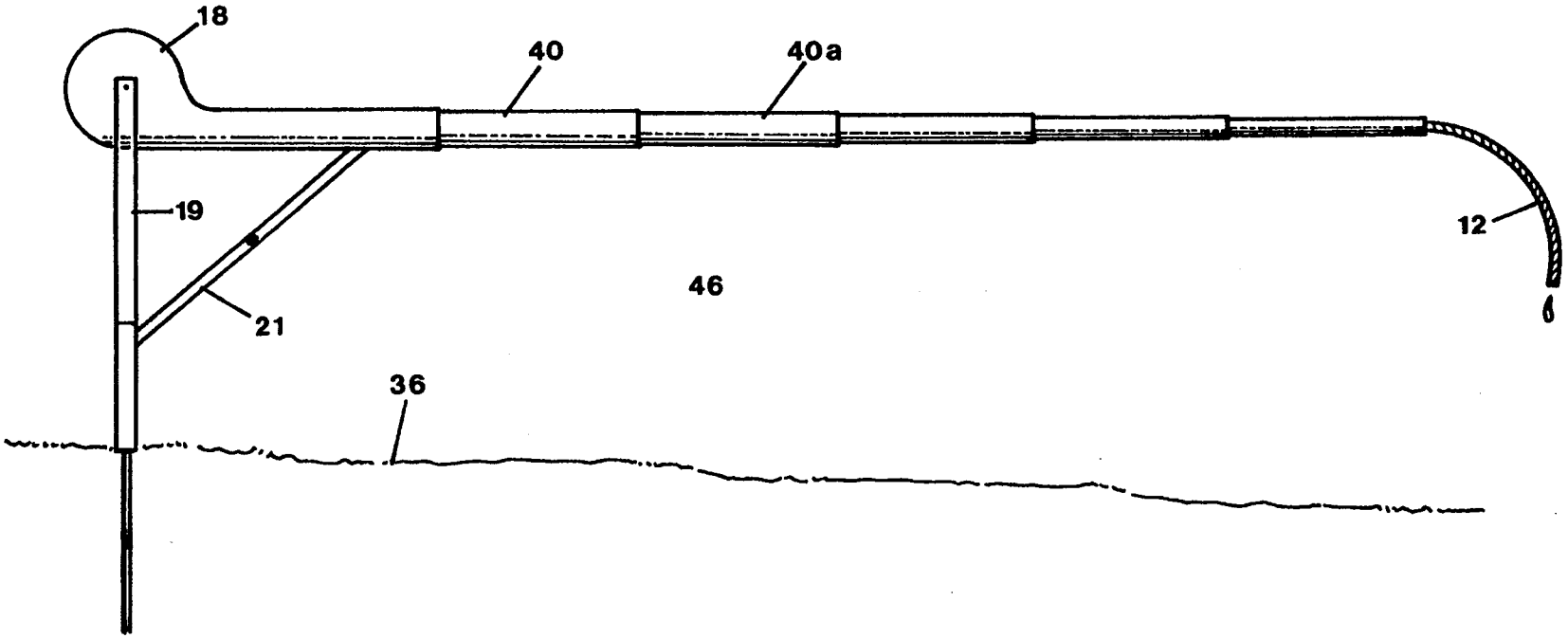
FIG. 4 is a schematic view of the reel and hose with the telescoping tubes projecting a maximum distance outwardly from the reel for support of the hose above the ground.
Figure 5:
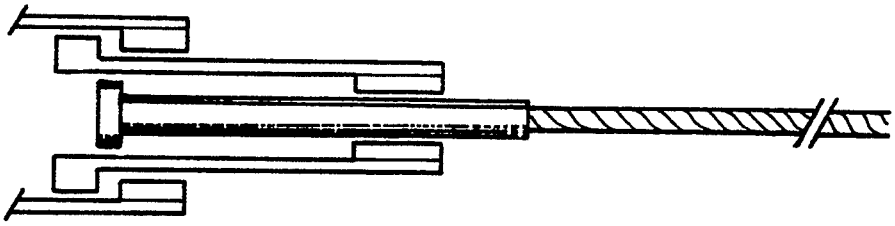
FIG. 5 is a view similar to FIG. 3 but showing the telescoping tubes extended and retracted.

FIG. 4 shows reel housing 18 in a schematic form, the reel housing being mounted on a rod 19 which extends into the ground and below ground level 36. This height is adjustable by making rod 19 into a pair of relatively telescoping parts a set screw between the parts. An adjustable brace 21 can also be used to brace the tubes 40 against the rod 19. In this way, the telescoping tubes 40 can form a unitary tube denoted by the numeral 40*a* which extends a relatively long distance outwardly from the reel 18. The hose 12 can then reach a relatively long distance away from the reel 18 and therefore be held above the space 46 below rod assembly 40*a* and above ground level 36. Thus, the hose will therefore not be interfering with flowers and shrubbery in space 46.

Figure 9:
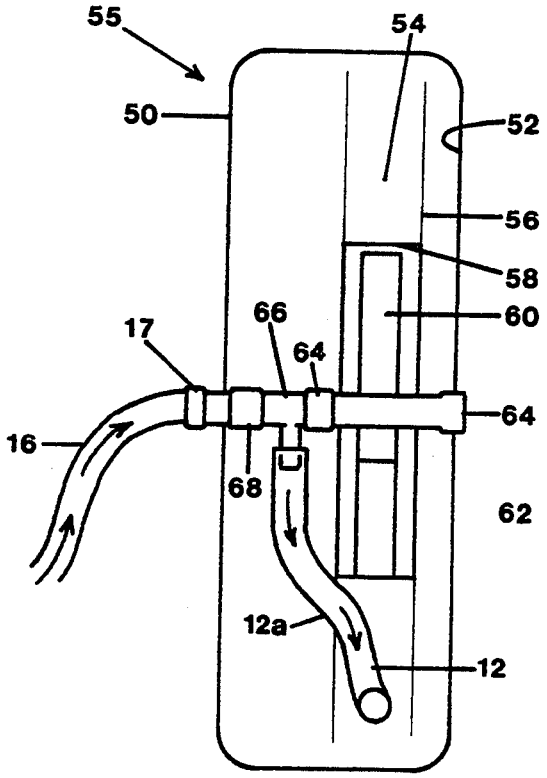
FIG. 9 is a fragmentary schematic view of the interior of the reel housing, showing the rotor for allowing rotation of the hose to avoid binding of the hose in the housing itself.

The interior of housing 18 is shown in FIG. 9. The housing includes two outer side walls 50 and 52 which have a pair of inner side walls 54 and 56 provided with an annular member 58 to from a rotable reel 55 on which the hose 12 is wound. A coiled leaf spring 60 is wound about a shaft 62 fixed at the ends thereof to inner side walls 54 and 56. The innermost end 64 of shaft 62 has a T-shaped member 66 which, by means of O-rings 67 is coupled at one end to end 64 of shaft 62. The opposite end of the crosspiece of T-shaped rotor member 66 is rotatably received within a sleeve 68 also coupled to T-shaped member 66 by O-rings 67.

Thus, the hose segment 16 is coupled by fitting 17 to sleeve 68. Hose 12 has an innermost end 12*a* which slips over the adjacent end of the T-bar member 66 so that hose segment 16 rotates relative to shaft 62 as the reel rotates about the axis of shaft 62.

While the structure of FIG. 9 is shown as being illustrative of the way in which hose segment 16 and garden hose 12 rotate relative to reel 10, it is clear that other structures may be provided to allow for this rotation. The main requirement is that the reel be rotatable relative to the hose so that the hose can deliver water to a remote location from the reel without interference with the structure of the reel itself.

Figure 10:
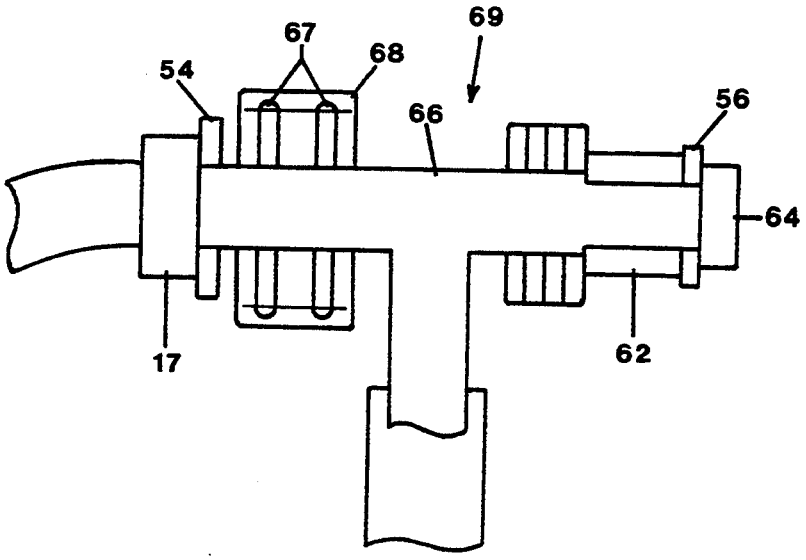
FIG. 10 is an enlarged, fragmentary, cross-sectional view of the rotary fitting structure in the reel housing of the present invention.

In operation, the reel housing 18 is mounted in some suitable manner, such as on a vertical wall by means of any suitable pivot structure, such as the pivot structure shown in FIGS. 1, 4 and 6. The hose segment 16 will first be coupled to a water faucet such as is shown in FIG. 2, and the faucet is turned on through connector structure 69 as shown in FIGS. 9 and 10.

The nozzle 14 (FIG. 1) can be manipulated to direct water to various parts of the surrounding area. It is also possible to use the telescoping tubes 40 when it is desired to avoid contact of the hose with shrubbery, bushes and the like, which are disposed below the hose as shown in FIG. 1. Thus, the tubes 40 which are generally rigid space the hose 27 above the ground level in FIG. 1 and this effectively protects the shrubbery and bushes in the space below the hose against damage due to the manipulation or movement of the hose over the ground. It is possible, of course, to use the hose without extending the tubes 40. When the tubes are extended, they form a single tube which is of maximum length, depending upon the length of the tubes themselves. In any case, the combined effect of the telescoping tubes, when expanded, is to provide a rigid support spaced above growth below the hose so as not to disturb the continued growth of the shrubs and plants all to the effect of protecting the growth below the hose.

It is clear from FIG. 1 that the reel can rotate about a vertical axis through the pin which forms a hinge pin for the system. This rotation of the reel can be manipulated by pulling on the hose after the user has moved into position where the hose reel can be pulled and rotated into an angular position relative to the building on which the system is used. The hose segment rotates with the T-shaped member 66 as does hose 12 as is clear from a review of FIGS. 9 and 10, FIGS. 7 and 8 showing the coil spring.

While the structure of FIGS. 1 and 4 have been shown to illustrate the way in which the reel is mounted above ground, it is clear that other structures can be used for this purpose.

Figure 11:
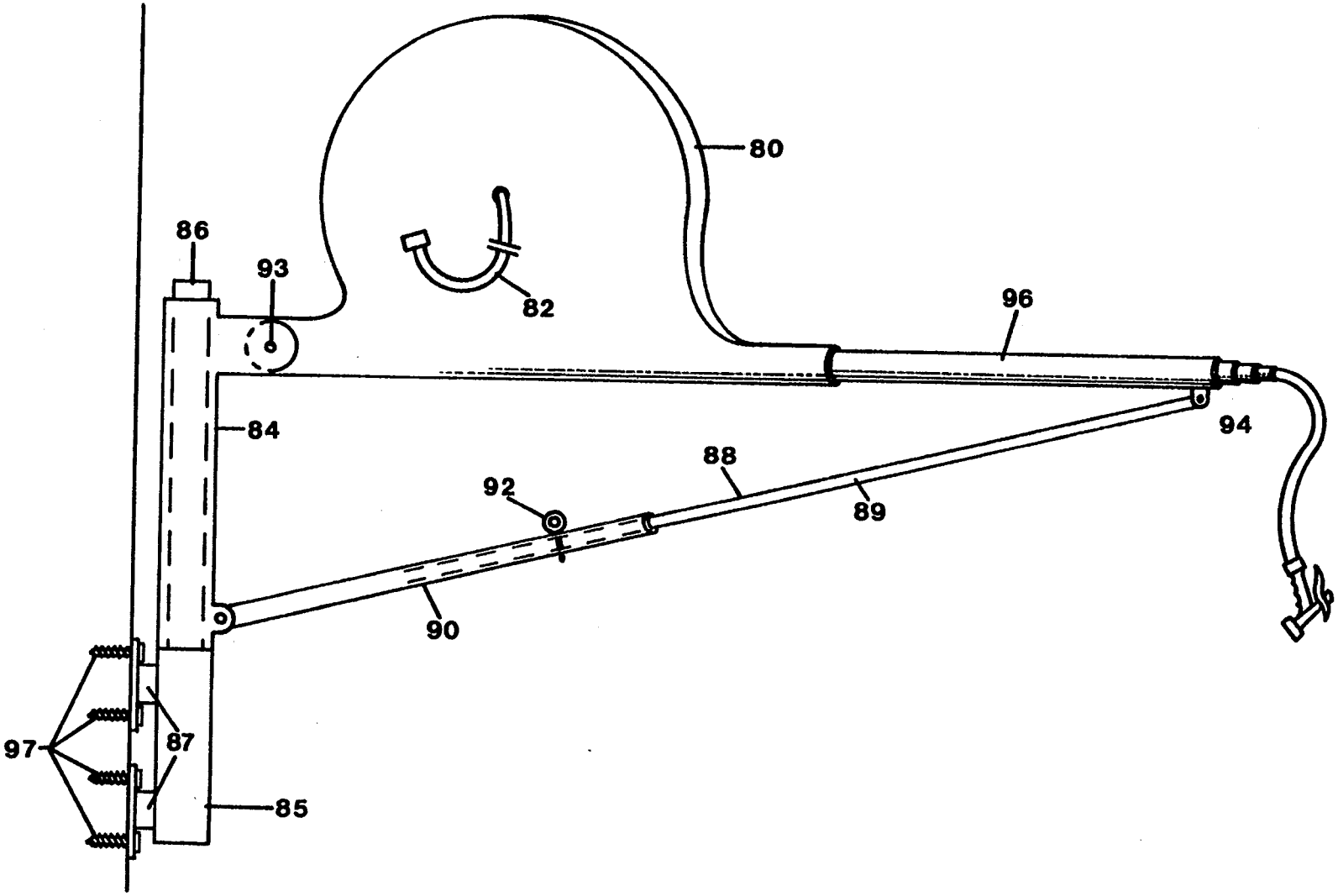
FIG. 11 is a side elevational view of a post mounted reel housing.

FIG. 11 shows reel housing 80 having a hose segment 82 for attachment to a water faucet. The housing has a tube 84 for mounting the housing on a post 86 which is driven into the ground or otherwise mounted in an upright position for rotation about a 360° angle. A brace 88 is provided with a first rod 89 receivable within a tube 90. A pin 92 receivable within holes in member 89 and tube 90 adjusts the length of the brace 88 so that the housing can pivot about on axis 93 in an up and down position and the length of brace 88 can be more or less horizontal or inclined. When inclined downwardly, the outer end 94 of the tube 96 coupled to housing 80 can be close to the ground yet the housing and tube 96 will be spaced above growth on the ground so as not to interfere with the growing of the growth on the ground. The inclined angle can be positive in a sense that the outer end 94 of tube 96 can be spaced a considerable distance above the ground so as to be able to extend over large shrubs and small trees growing into the ground over above which housing 80 is located.

The tube 84 is received within a sleeve 85 (FIG. 11) and the sleeve has projections 87 which are coupled by lag bolts 97 and these lag bolts can go into a wall or fence or other supports when it is desired to mount the reel housing 80 for rotation at least about an angle 180°.

Figure 12:
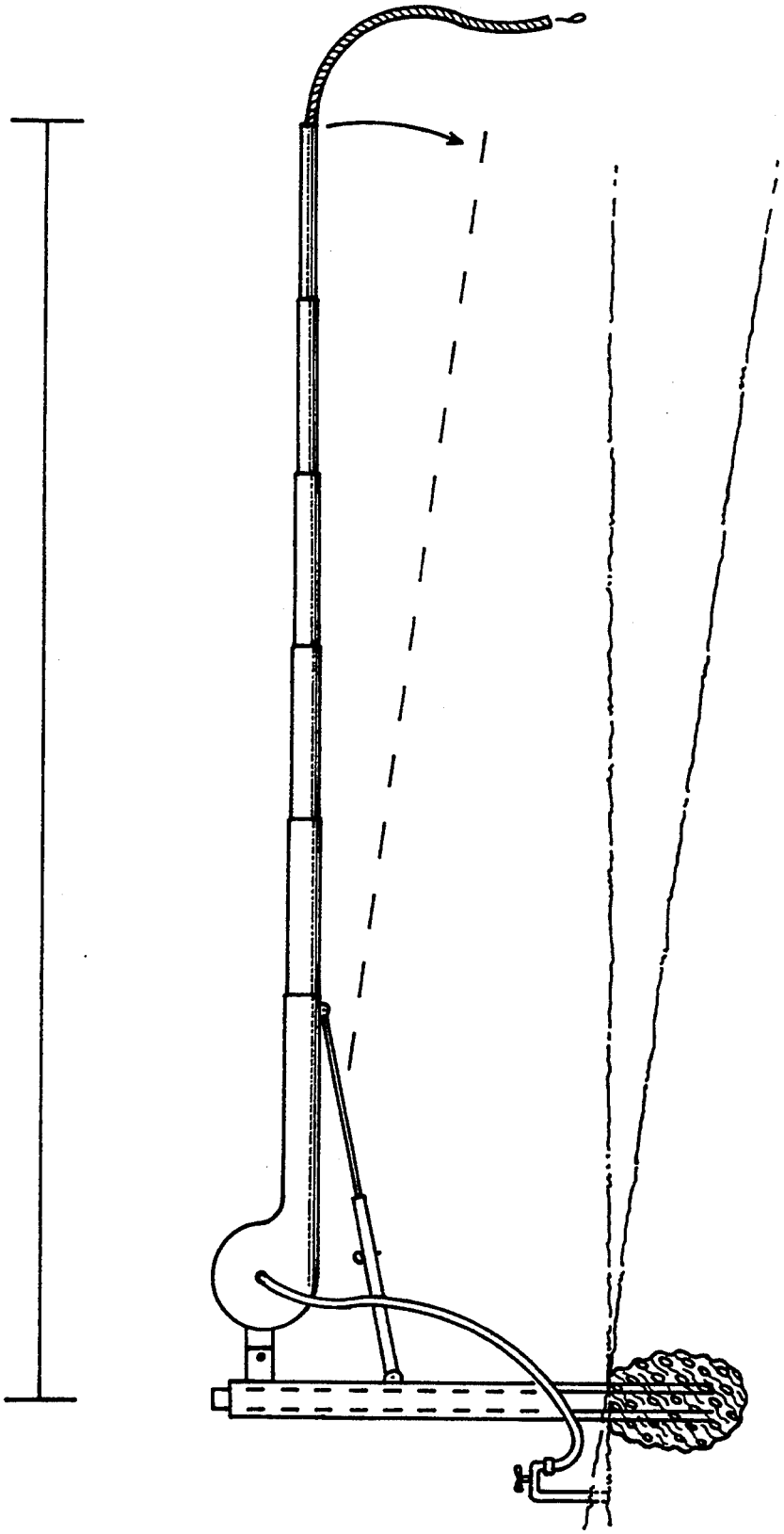
FIG. 12 is a view similar to FIG. 11 but showing the way in which the telescoping tube, when extended, can droop at several different angles or levelers and sloped earth.

FIG. 12 shows a drooping of the rod or tube 90 when the individual telescoping tubes extend a maximum distance outwardly from an upright post whose height can be adjusted by the adjusting of bolts passing through holes in a sleeve shiftably mounted on a rod, the latter being embedded in the ground.

Thus, the present invention can be made such that the reel housing and the reel within the housing can be made to be movable about an angular distance of 180°, 270° or 360°, depending upon whether the mounting means or the reel housing is done with the corner of a building or a post.

The other possible uses for the present invention are as follows:

1. Oil and grease dispensing;
2. Car washing;
3. Steam cleaning; and
4. Pneumatic air tools.

What is claimed is:

1. A reel assembly for a garden hose comprising:

an annular housing adapted to be mounted in a fixed position; a reel in said housing for rotation in a plane; a hose segment adapted to be coupled to a water source;

said reel being axially mounted in the housing, said housing having a sidewall provided with an opening for receiving the hose segment and allowing the hose to be pulled into the housing and wrapped around the reel when the reel rotates in one direction relative to the housing;

a rotary fitting coupling the hose segment to the hose; and said housing having means selectively extending outwardly from the housing for supporting the hose above ground level, said hose supporting means includes telescoping tubes, the tubes extending outwardly from and tangential to the housing, said hose extending through the tubes, the hose extending outwardly from the reel through the outermost tube when the tubes extend outwardly from the housing.

2. An assembly as set forth in claim 1, wherein the hose has a hose segment coupled with the rotary fitting for rotation of the fitting and thereby the hose segment relative to the hose wrapped on the reel within the housing.

3. An assembly as set forth in claim 1, wherein the housing is mounted on an upright post, a sleeve means being secured to the housing.

4. An assembly as set forth in claim 1, wherein is included an adjustable brace coupled to the innermost tube near the outer end thereof, the brace can be adjusted in length to mount the reel at any desired angle with respect to the level ground therebelow.

5. An assembly as set forth in claim 1, wherein the housing has a sleeve, there being an upright post for receiving the sleeve, one end of the brace being coupled to the lower end of the sleeve and the opposite end of the brace being coupled to a telescoping tube, the housing having a pivot point near the top of the post for rotation about a horizontal axis to thereby permit drooping of the housing when such is desired.

* * * * *